US006407729B1

(12) United States Patent
Moon

(10) Patent No.: US 6,407,729 B1
(45) Date of Patent: Jun. 18, 2002

(54) LCD DEVICE DRIVING SYSTEM AND AN LCD PANEL DRIVING METHOD

(75) Inventor: Seung-Hwan Moon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/510,197

(22) Filed: Feb. 22, 2000

(30) Foreign Application Priority Data

Feb. 22, 1999 (KR) ..... 99-5829
Feb. 22, 1999 (KR) ..... 99-5830

(51) Int. Cl.[7] ..... G09G 3/36
(52) U.S. Cl. ..... 345/99; 345/205; 345/213
(58) Field of Search ..... 345/99, 205, 213, 345/100, 204, 89

(56) References Cited

U.S. PATENT DOCUMENTS 5,856,818 A * 1/1999 Oh et al. ..... 345/99
6,288,699 B1 * 9/2001 Kubota et al. ..... 345/99

* cited by examiner

*Primary Examiner*—Chanh Nguyen
*Assistant Examiner*—Fritz Alphonse
(74) *Attorney, Agent, or Firm*—McGuireWoods LLP

(57) ABSTRACT

A driving system of an liquid crystal display (LCD) device and an LCD driving method in which an insufficient charging of a liquid crystal capacitor caused by a delayed time taken for raising source and gate signals applied to each pixel of the LCD panel to normal voltage levels is overcome by delaying the source signal output by a predetermined number of source driver IC units or by delaying the gate signal that is output by a predetermined number of gate driver IC units, includes a power supply unit, a controller, a gray voltage generating unit, a gate voltage generating unit, a source drive unit, a gate drive unit, and a liquid crystal panel, wherein the source drive unit or the gate drive unit has a delay unit for delaying an enable signal or a load signal, to thereby output delayed source and gate signals. As a result, a charging rate of the liquid crystal capacitor of pixels contained in the liquid crystal panel is enhanced, which prevents a degradation of the screen and ensures a uniformity achieving a large screen and a high resolution.

22 Claims, 13 Drawing Sheets

LCD DEVICE DRIVING SYSTEM AND AN LCD PANEL DRIVING METHOD

BACKGROUND OF THE INVENTION

1. Field of the Invention

The present invention relates to a driving system of a liquid crystal display (LCD) device, and more particularly, to a driving system of an LCD device and an LCD driving method in which an insufficient charging of a liquid crystal capacitor caused by a delayed time taken for raising source and gate signals applied to each pixel of the LCD panel to normal voltage levels is overcome by delaying the source signal generated by a predetermined number of source driver IC units or by delaying the gate signal output by a predetermined number of gate driver IC units.

2. Description of the Related Art

An LCD device is a widely used form of a flat panel display. It takes advantage of light transmittance variations of liquid crystal depending on the voltages applied to each pixel. Especially, the smaller dimension, lighter weight and lower power consumption make an LCD device replace a traditional cathode ray tube (CRT).

LCD devices consist of a liquid crystal panel module, a backlight assembly, and other fixtures. The liquid crystal panel module is a liquid crystal panel with a printed circuit board (PCB) attached. Source driver ICs, gate driver ICs and other components, for example, a controller, are mounted onto the PCB.

A liquid display panel displays an image. Data signals and gate signals are applied to each pixel of the liquid crystal panel. A gate signal is applied to a gate electrode of a thin film transistor (TFT) via a gate line formed in the liquid crystal panel.

The TFT is turned on or off according to a level of the gate voltage. When the TFT is turned on or off according to a gate voltage, the liquid crystal array changes according to the electric field between a pixel electrode and an opposing electrode determined by a voltage level applied to a source electrode. Thus, the liquid crystal capacitor is charged, which varies the degree of light transmittance.

A liquid crystal display displays a certain image according to the above-described method.

Referring to FIG. 1, a gate drive unit 4 having a plurality of gate driver ICs applies gate signals to a liquid crystal panel 2 and a data drive unit 6 having a plurality of source driver ICs applies source signals to a liquid crystal panel 2. Gate drive unit 4 sequentially applies gate signals to the liquid crystal panel 2 vertically in order to turn on and turn off the pixel. Data drive unit 6 sequentially applies source signals to the liquid crystal panel 2 horizontally to charge the liquid crystal. A timing for applying gate voltages and source voltages is set as shown in FIG. 2A.

However, generally, the gate signal is gradually delayed as it goes from position A toward position B of liquid crystal panel 2, and the source signal is delayed as it goes from position A toward position C.

In more detail, as shown in FIG. 2A, the voltages applied for gate signals and source signals are in order at position A of FIG. 1. The gate voltage swings between turn-on voltage Von of 20V and turn-off voltage Voff of −-7V, and the source voltage has a black level which varies in accordance with a positive or a negative polarity.

Voltages of the source signal for each pixel swing between voltage V+ and voltage V− for indicating a specific grey level according to the polarity. In FIG. 2, G and S respectively denote the gate voltage and the source voltage. A data signal is applied to a source electrode of TFT as a gray voltage. Hereinafter, data signals and source signals may be used interchangeably.

Source signals and gate signals have timings according to a preset sequence as shown in FIG. 2A. A gate signal rises a certain period after a source signal has risen. The source signal falls down a certain period after the gate signal has fallen. When the source signal maintains the voltage level of V+, the gate signal transits to the turn-on level. Thus, a TFT turns on a pixel and the signal is charged to the liquid crystal capacitor. The source signal charges the liquid crystal capacitor during the time gap Ts, and the lowered gate signal turns off the TFT and pixel during the time gap Tg. These time gaps are adjustable.

Meanwhile, the liquid crystal panel 2 has a resistance and a capacitance due to the gate lines and the data lines. The resistance and the capacitance change the waveforms of source signals and gate signals at each position, as shown in FIG. 2. The waveforms change more as getting away from the terminal where signals are applied. Therefore, as shown in FIGS. 2B and 2D, the waveform of the gate signal changes slowly as getting away from the gate drive unit 4, and as shown in FIGS. 2C and 2D, the waveform of the source signal changes slowly as getting away from the data drive unit 6.

In general, a scanning period of a gate line gets shorter as high resolution and large screen products are developed. When driving a liquid crystal display as shown in FIG. 2, a conventional driving method may not secure a sufficient turn-on time for the pixel. Especially, pixels may be dramatically undercharged when the line resistance and capacitance affect the source signals and the gate signals. This degrades the picture quality and an overall uniformity of display.

As the technology for a high resolution and large screen display develops, a need has risen for a method to secure a sufficient charging time for the liquid crystal capacitor even when a gate line scanning period gets shorter.

SUMMARY OF THE INVENTION

It is therefore an object of the present invention to adjust a source signal to be delayed by data line units connected to a source driver IC, considering that it takes longer for gate signals and source signals to rise to the level required for charging the liquid crystal capacitor as getting away from the terminal to which gate signals and source signals are applied. This ensures a turn-on time period of a pixel and enhances a charging rate of a liquid crystal capacitor.

It is another object of the present invention to adjust a gate signal to be delayed by gate line units connected to a gate driver IC, considering that it takes longer for gate signals and source signals to rise to the level required for charging the liquid crystal capacitor as getting away from the terminal to which gate and source signals are applied. It also ensures a turn-on time period of a pixel and enhances a charging rate of a liquid crystal capacitor.

According to one aspect of the present invention, there is provided a driving system of an LCD device including a power supply unit for supplying a direct current voltage, a controller for outputting data and control signals for forming a selected image, a gray voltage generating unit for generating a plurality of gray voltages using a voltage supplied from the power supply unit, a gate voltage generating unit for outputting a gate voltage using the voltage supplied from the power supply unit, a source drive unit for outputting source signals with an input of the data, a portion of the signal contained in the control signals, and the gray voltages, a gate drive unit for outputting gate signals by having other portion of the signal contained in the control signals, and a gate turn-off or turn-on voltage applied thereto, and a liquid crystal panel for displaying the image driven by the gate and source signals applied thereto.

Here, the data drive unit includes a delay part that accepts a load signal and outputs load signals delayed as passing through a first, a second, a third, . . . , and an mth delay units, and n number of source driver ICs that outputs a certain number of source signals according to the control signals ($n \geqq m$). Load signals from the delay units are applied to at least one source driver IC that outputs the source signal delayed according to the delay time of the load signal.

The delay part consists of a serially arranged delay units having a resistance and a capacitor arranged in parallel. It delays the load signal. Preferably, the first input load signal and the delayed load signal coming from each delay unit are input to at least one source driver IC. The delay unit corresponds one-to-one to the source driver IC or one-to-many to the source driver ICs.

According to another aspect of the present invention, there is provided a driving system of an LCD device including a power supply unit for supplying a DC voltage, a controller for outputting data and control signals for forming a selected image, a gray voltage generating unit for generating a plurality of gray voltages using the voltage applied from the power supply unit, a gate voltage generating unit for outputting a gate turn-on and turn-off voltage using the voltage applied from the power supply unit, a source drive unit for outputting source signals by having the data, a portion of the signal contained in the control signals, and the gray voltage which are input thereto, a gate drive unit for outputting gate signals by having other portion of the signal contained in the control signals, and the gate turn-on or turn-off voltage are applied thereto, and a liquid crystal panel for displaying the image being driven by the gate and source signal applied thereto.

Here, the gate drive unit includes a delay part that accepts an enable signal and outputs enable signals delayed as passing through a first, a second, a third, . . . , and an xth delay units, and y number of gate driver ICs for outputting a predetermined number of gate signals being driven by the control signals (wherein, $y \geqq x$). Enable signals from the delay units are input to at least one gate driver IC that outputs the gate signal delayed according to the delay time of the enable signal.

The delay part consists of a serially arranged delay units having a resistance and a capacitor arranged in parallel. It delays each enable signal. Preferably, the first input enable signal and the delayed enable signals coming from each delay unit are input to at least one gate driver IC. The delay unit may correspond one-to-one to the gate driver IC or one-to-many to the gate driver ICs.

According to the present invention, there is provided a liquid crystal panel driving method in which gate signals and source signals are output to the liquid crystal panel by driving a plurality of gate and source driver ICs in accordance with a data signal for displaying an image, control signals, gray voltages, or a selectively applied gate turn-on or turn-off voltage and operating the liquid crystal panel by said gate and source signals, wherein the gate and the source signals has a sequence of the source signal rising, the gate signal turning on, the gate signal turning off, and the source signal falling, and the source signals are divided into a selected number of source line units, and applied to the liquid crystal panel being accumulatively delayed by a selected time from the time when the gate signal is turned off.

According to the present invention, there is provided a liquid crystal panel driving method, including the steps of outputting gate and source signals to the liquid crystal panel by driving a plurality of gate and source driver ICs in accordance with a data signal for displaying an image, control signals, gray voltages, or a selectively applied gate turn-on or turn-off voltage and operating the liquid crystal panel by a gate and a source signals, wherein the gate and the source signals has a sequence of the source signal rising, the gate signal turning on, the gate signal turning off, and the source signal falling, and the gate signals are divided into a selected number of gate line units, and applied to the liquid crystal panel being accumulatively delayed by a selected time from the time when the source signal is applied.

Here, the gate signal is accumulatively delayed for each gate driver IC and applied to the liquid crystal display. Preferably, the gate driver IC most adjacent to the output terminal of the source signal, from the liquid crystal panel, outputs a gate signal being delayed by total delay time divided by the total number of gate driver lCs after the source signal is output. Subsequently, the other gate driver ICs output gate signals delayed by the total time delay/total number of gate driver ICs.

BRIEF DESCRIPTION OF THE DRAWINGS

The above object and other advantages of the present invention will become more apparent by describing in detail the preferred embodiments thereof with reference to the accompanying drawings, in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein.

The first embodiment (FIGS. 6 to 9) of the present invention is for compensating for a delay of a gate line by delaying the source, signal, and the second embodiment (FIGS. 10 to 12) of the present invention is for compensating for a delay of a data line by delaying the gate signal.

Figure 1:
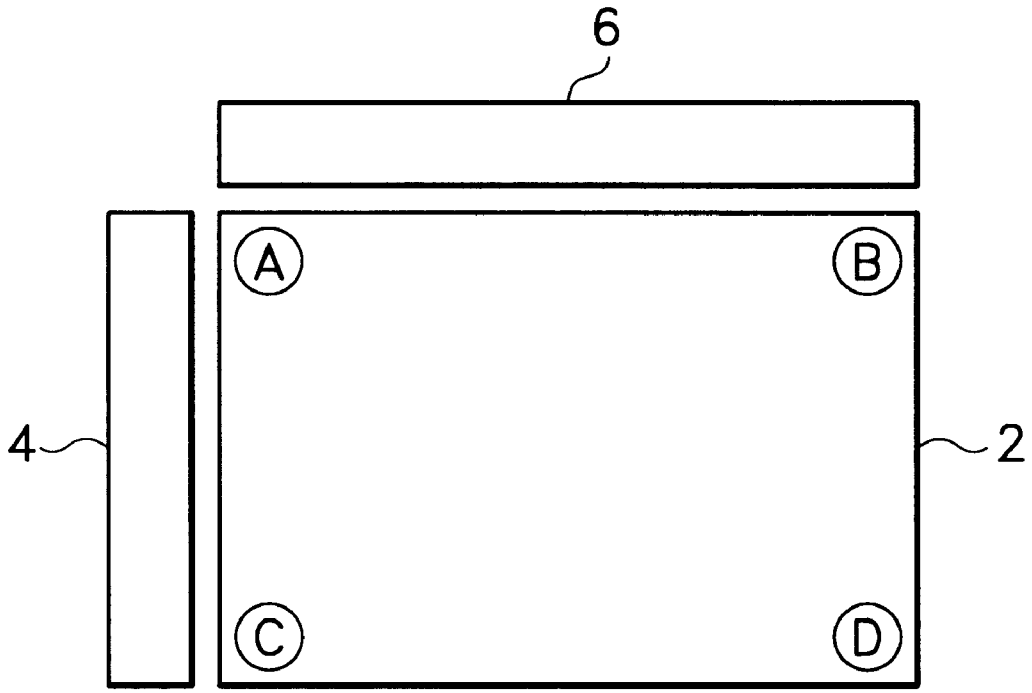
FIG. 1 (Prior Art)
FIG. 1 is a block diagram showing a conventional LCD module.
Figure 2A:
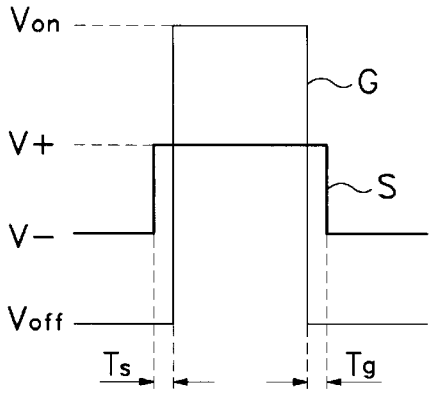
FIG. 2A (Prior Art)
FIGS. 2A to 2D illustrate waveforms of a gate voltage and a source voltage by pixel units of the liquid crystal panel shown in FIG. 1.
Figure 2B:
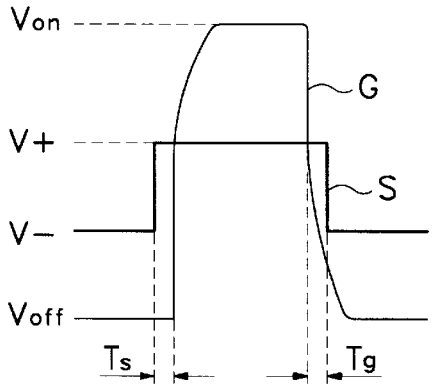
FIG. 2B (Prior Art)
Figure 2C:
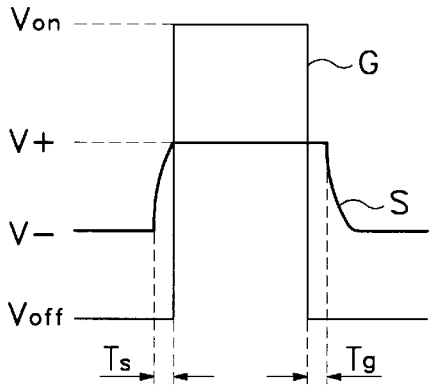
FIG. 2C (Prior Art)
Figure 2D:
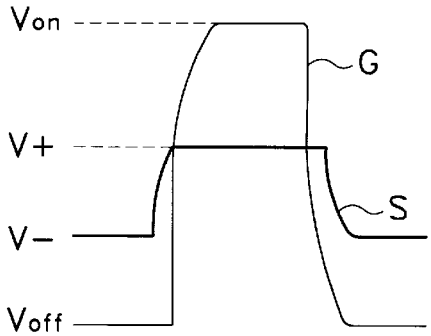
FIG. 2D (Prior Art)
Figure 3:
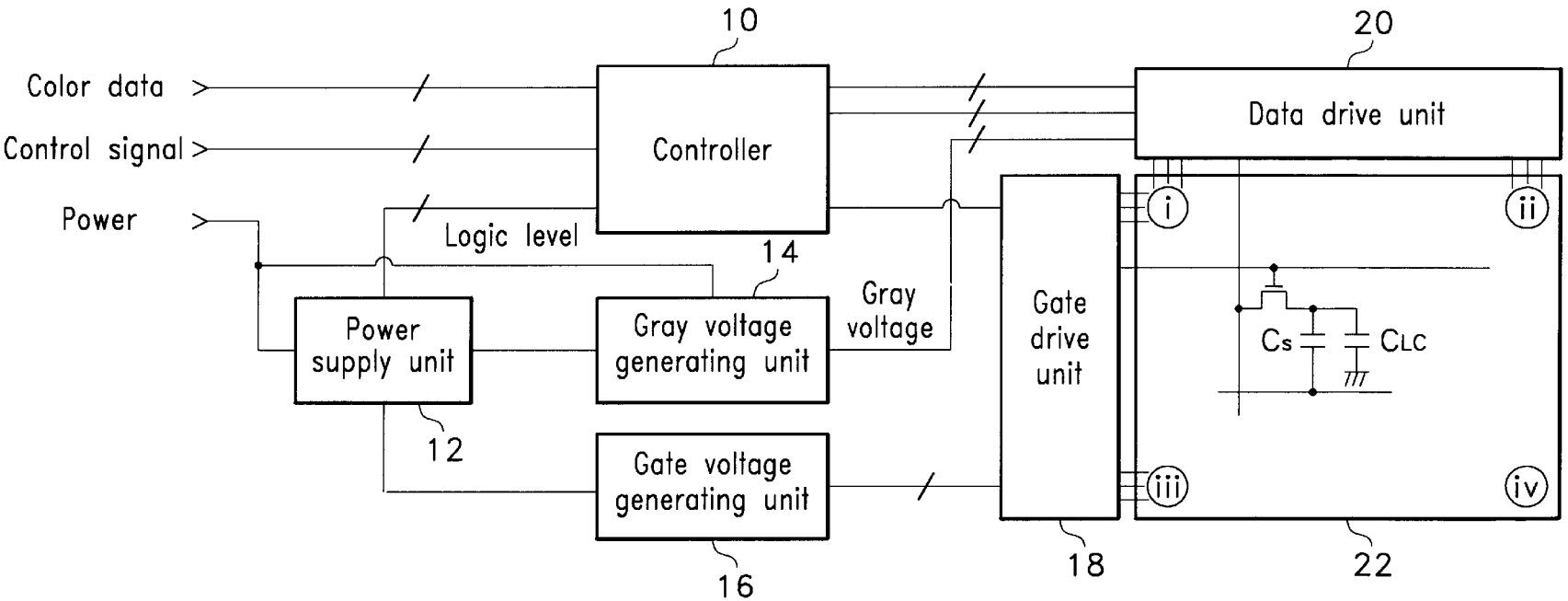
FIG. 3 is a block diagram showing an LCD device according to the present invention.

Referring to FIG. 3, a controller 10 receives a selected color data and a control signal. A power supply unit 12 receives a DC power and supplies stable voltages to a controller 10, a gray voltage generating unit 14, and a gate voltage generating unit 16. Gray voltage generating unit 14 provides gray voltages to a source drive unit 20. Gate voltage generating unit 16 provides voltages to a gate drive unit 18 to generate a turn-on voltage and a turn-off voltage. Gate drive unit 18 and data drive unit 20 have a plurality of gate driver ICs and source driver ICs.

Controller 10 outputs control signals and data signals. Data signals determine gray levels for each pixel. Gate drive unit 18 receives control signals and data drive unit 20 receives data signals.

Data drive unit 20 applies source signals to the liquid crystal panel 22 and gate drive unit 18 applies gate signals to the liquid crystal panel 22.

Liquid crystal panel 22 has a TFT at each intersection of matrix defined by gate lines and data lines. The source of the TFT receives a source signal and the gate of the TFT receives a gate signal. The TFT forms a storage capacitor $C_s$ and liquid crystal capacitor $C_{LC}$ at its drain.

Figure 4:
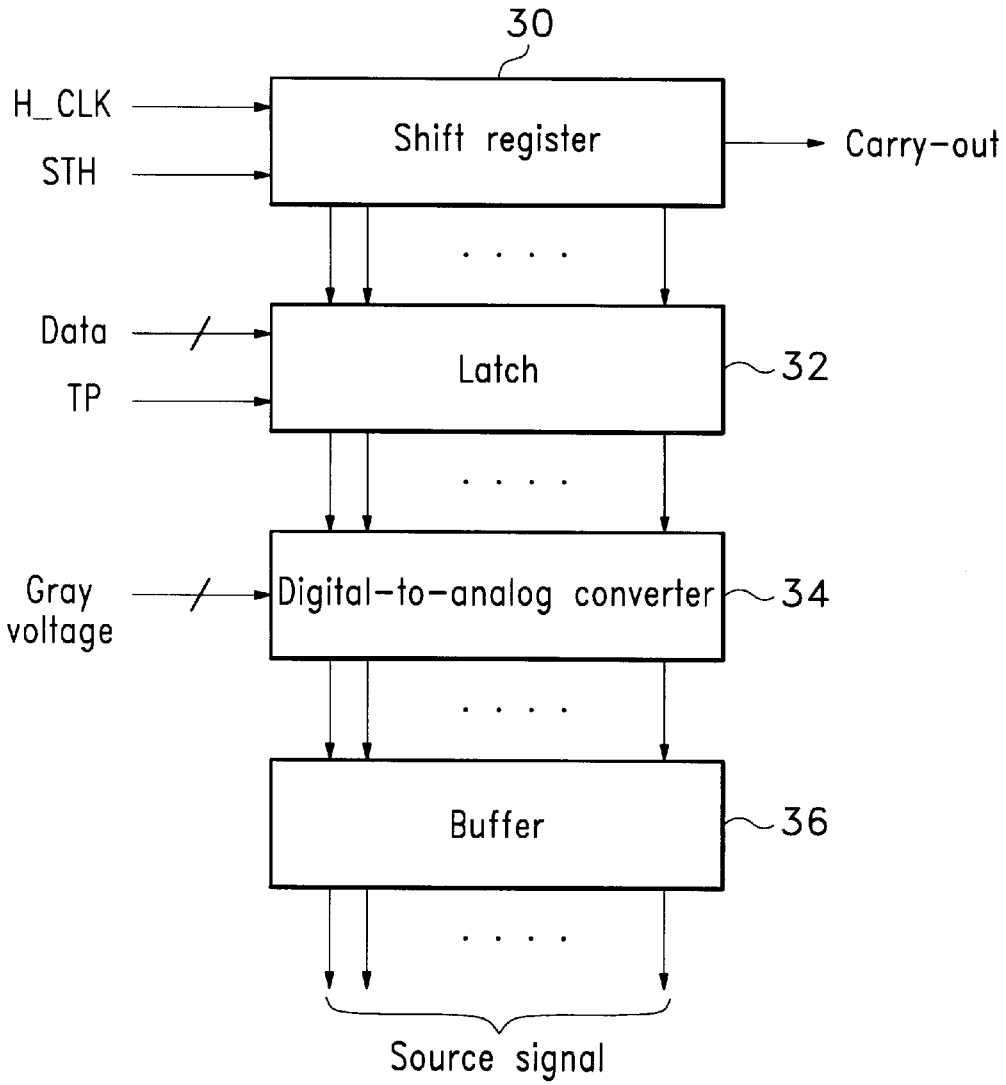
FIG. 4 is a detailed block diagram showing an individual source driver IC of the data drive unit shown in FIG. 3.

FIG. 4 shows the structure of the individual source driver IC, which is a component of source drive unit 20. It has a shift register 30, a latch 32, a digital-to-analog converter 34, and a buffer 36. A shift register 30 receives a horizontal clock signal H—CLK and a shift signal STH that have a predetermined frequency. Here, the horizontal clock signal H—CLK has a frequency of a master clock signal from the controller 10 divided by two or four. The shift signal STH is input by one pulse per one horizontal period.

Shift register 30 outputs pulses horizontally to latch 32 at every certain number of clocks, according to the horizontal clock signal H—CLK. A certain number of shift signals generate a carry-out signal. The carry-out signal is applied to the subsequent shift register (not shown).

Image data from controller 10 is serially input to latch 32. The latch 32 then stores the data according to a shift sequence of shift register 30 and outputs data when it receives a load signal TP.

Digital-to-analog converter 34 encodes the data coming from latch 32 and selects the gray voltage for each source line. Then, the digital-to-analog converter 34 selects a voltage according to the encoding from the gray voltages generated by gray voltage generating unit 14 and outputs it to buffer 36. Gray voltages are output for each line according to the sequence of the data input of latch 32.

Buffer 36 receives gray voltages from digital-to-analog converter 34 and controls their output. Source signals are gray voltages applied to liquid crystal panel 22.

Gate drive unit 18 consists of a plurality of delay units and gate driver ICs. Each gate driver IC has a shift register 40, a level shifter 42, and an amplifier unit 44.

Shift register 40 receives a shift signal STV and a vertical clock signal V—CLK and outputs a plurality of signals in a vertical direction. Then, it generates a carry-out signal to feed another shift register as a carry-in signal.

Gate voltage generating unit 16 sends turn-on voltage Von and turn-off voltage Voff to level shifter 42. Level shifter 42 converts input signals from shift register 40 to a turn-on voltage or a turn-off voltage level and outputs them to amplifier unit 44.

Amplifier unit 44 amplifies the input signal to a predetermined gain value and sends it to liquid crystal panel 22 as a gate signal. Here, an output enable signal OE determines the output of amplifier unit 44.

Figure 6:
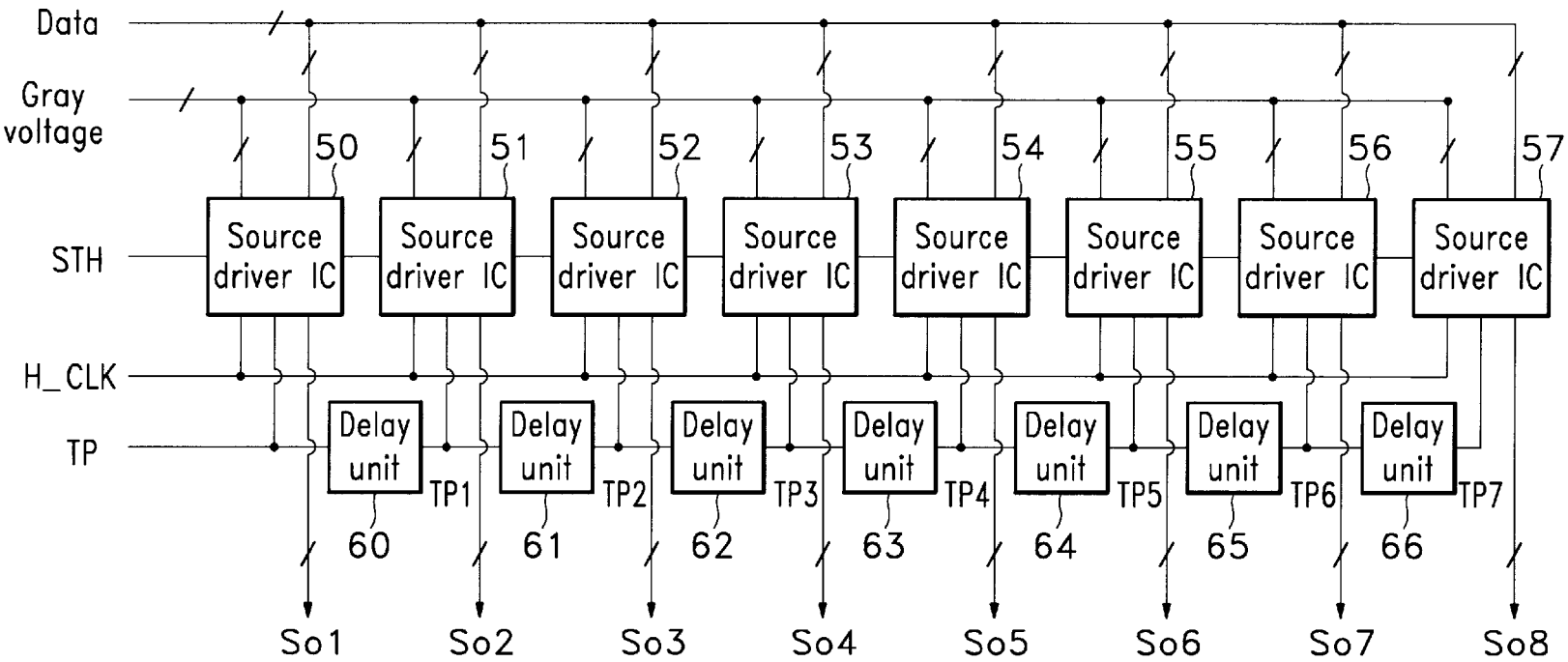
FIG. 6 is a block diagram showing a structure of the source driver ICs constituting the data drive unit shown in FIG. 3 according to a first embodiment of the present invention.

FIG. 4 is a detailed block diagram showing an individual source driver IC of the source drive unit shown in FIG. 3. FIG. 6 shows data drive unit 20 made up of such source driver ICs as a first embodiment.

The number of source driver ICs of data drive unit 20 may vary according to the purpose and the resolution of products. The first embodiment consists of eight source driver ICs.

Data drive unit 20 as shown in FIG. 6 has source driver ICs 50 through 57 that receive horizontal clock signal H—CLK, gray voltages, and data.

Source driver IC 50 receives shift signal STH and transmits the carry-out signal to the subsequent driver IC 51. The carry-out signal transmits from a source driver IC 51 through a source driver IC 57.

A load signal TP is input to delay unit 60 and source driver IC 50, and delayed by a predetermined time period sequentially passing through delay units 60 through 66. Delay units 60 through 65 input load signals TP1 through TP6 to driver ICs 51 through 56 and delay units 61 through 66 respectively. Delay unit 66 inputs the final-delayed load signal TP7 to source driver IC 57.

If the total amount of source voltage delay time is "B", load signal TP1 is set to rise earlier than the gate signal by a period of "B" or longer. Then, each of load signals TP2 through TP7 are respectively delayed by a period of "B/8", and applied to source driver ICs 51 through 57. Output operation of the source signal will be explained in more detail with reference to FIG. 8.

Figure 7:
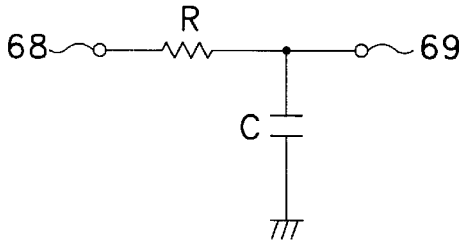
FIG. 7 is a circuit diagram of the delay unit shown in FIG. 6.

As shown in FIG. 7, the delay unit is made up of an RC delay circuit having a resistance R and a capacitor C. The signal to an input terminal 68 is delayed by a predetermined time period and output via an output terminal 69. Here, a parasitic capacitor formed by data lines and gate lines can be used.

The first embodiment applies the source signal to the liquid crystal panel in a fashion that the source signal rises before the gate signal rises to a turn-on level and falls after the level of the gate signal falls down to a turn-off level, for a selected pixel.

The first embodiment sets the finally delayed source signal to fall down prior to or at lest at the same time when the gate signal transits to the turn-off level. Provided that the final delay time of the source signal is "Tg", each source signal is delayed by "Tg/number of source driver ICs." For example, source signal So1 from source driver IC 50 falls down delayed by "Tg/number of source driver ICs", after the gate signal transits to the turn-off level. Accordingly, source signals So2 through So7 that are respectively coming from source driver ICs 51 through 56 are accumulatively delayed by a period of "Tg/number of source driver ICs". Thus, the source signal So8 from source driver IC 57 falls down delayed by a period of Tg, after the gate signal starts to transit down to the turn-off level.

Figure 8:
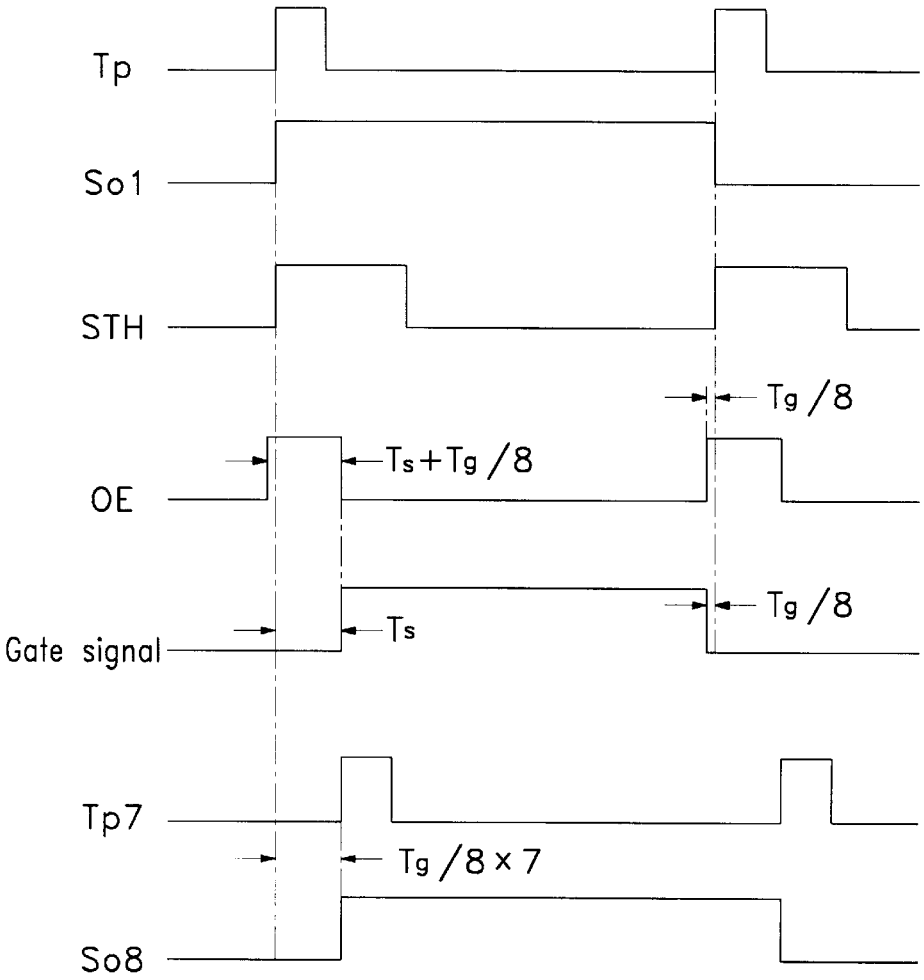
FIG. 8 illustrates a waveform of the delayed source signal according to a first embodiment of the present invention.

Delay operation of the source signal will be explained with reference to FIG. 8 hereinafter. Gate drive unit 18 outputs the gate signal at the falling edge of the output enable signal OE coming from controller 10. Data drive unit 20 receives shift signal STH and load signal TP and source driver ICs 50 through 57 output source signals So1 through So8.

When source driver IC 50 receives shift signal STH, it generates a carry-out signal through an internal operation of the shift register and transmits it to the subsequent source driver IC 51 as a carry-in signal. Source driver IC 52 in turn generates a carry-out signal through an internal operation of the shift register and inputs the same to the subsequent source driver IC 53 as a carry-in signal. In this manner, carry-out signals are sequentially input to source driver ICs. Each of source driver ICs 50 through 57 latches data, when received shift signal STH or the carry-out signal. Source driver ICs 50 through 57 output source signals to the liquid crystal panel when received the load signal.

Source driver ICs 50 through 57 output source signals delayed corresponding to the delay of load signals TP through TP7 which are delayed by Tg/8, 2Tg/8, 3Tg/8, 4Tg/8 , . . . 8Tg/8(equals Tg) to a plurality of source lines.

Accordingly, source driver IC 51 has output source signal So2 delayed by Tg/8 compared to the output source signal So1 of source driver IC 50, and source driver IC 52 in turn has output source signal So3 delayed by Tg/8 compared to the output source signal So2. Thus, each source signal is accumulatively delayed. As a result, source signal So8 of source driver IC 57 is delayed by 7 Tg/8 than source signal So2.

Figure 9:
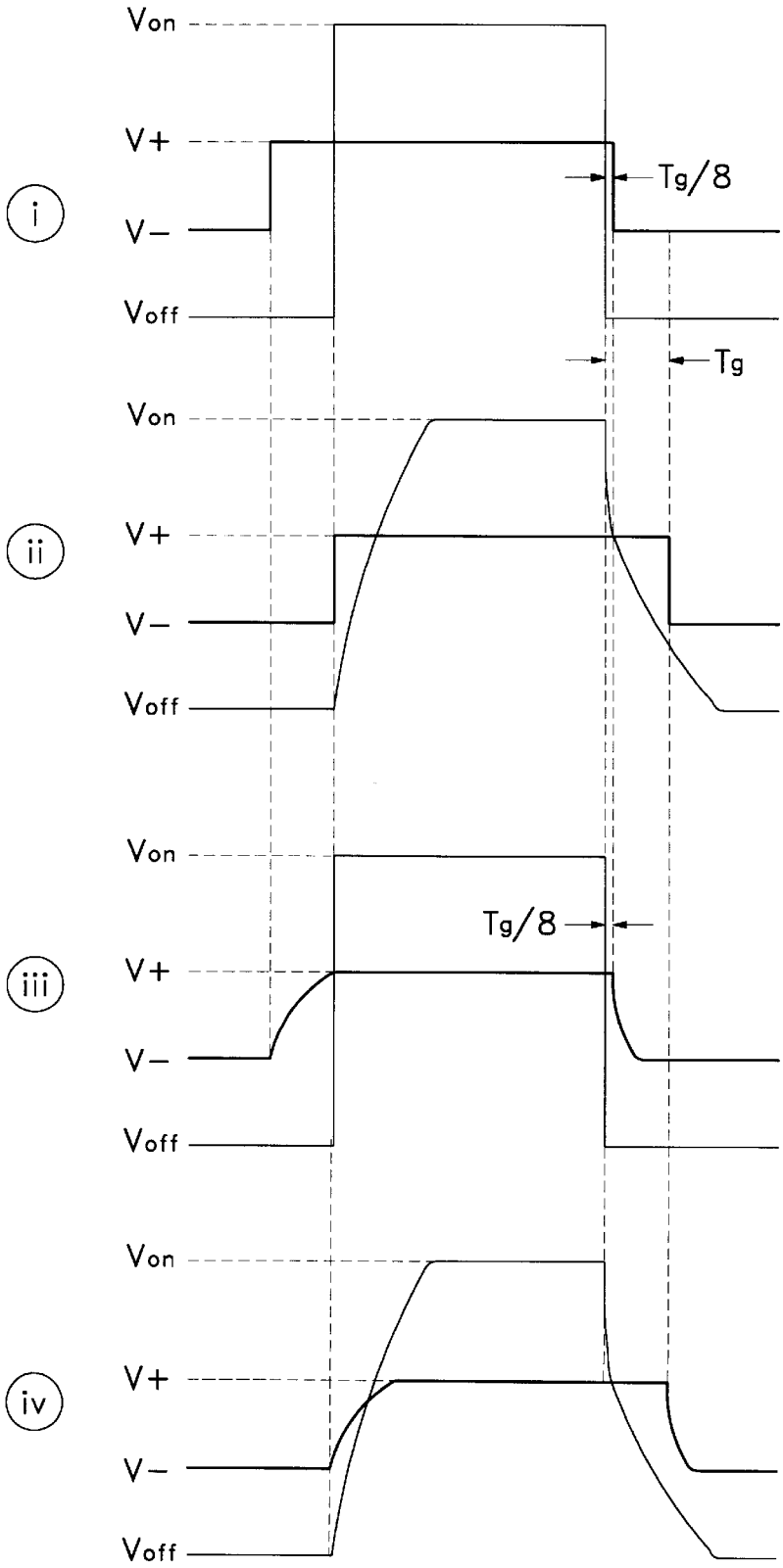
FIG. 9 illustrates waveforms of a gate voltage and a source voltage for each pixel according to a first embodiment of the present invention.

FIG. 9 shows source and gate signals applied to each pixel according to the first embodiment. Here, i) through iv) are source and gate signals applied to positions i) through iv) of liquid crystal panel 22 of FIG. 3. Positions i) and ii) are for the pixels that receive a source signal at first, and positions i) and iii) are for the pixels that receive a gate signal at first.

At positions i) and iii) of liquid crystal panel 22, the time gap between the transition of the gate signal to the turn-off level and the falling of the source signal is Tg/8. Pixels at positions i) and iii) receive. Source signal So1 output from source driver IC 50 at the same time. In addition, turn-on period of the level of the gate signal is contained in a period when the source signal has a normal level. Thus, pixels at positions i) and iii) can be charged to the desired voltage level. As a result, a light transmittance can be performed at a correct gray level.

At positions ii) and iv) of liquid crystal panel 22, the time gap between the transition of the gate signal to the turn-off level and the falling of the source signal is 7Tg/8, as the source signal is accumulatively delayed. Pixels at positions ii) and iv) are those to which source signal So8 output from source driver IC 57 is applied at the same time. Positions ii) and iv) are farthest from the gate drive unit and where the gate signal is extremely delayed due to the resistance and capacitance. Turn-on period of the gate signal is contained in a period when the source signal has a normal level. Thus, pixels at positions ii) and iv) can be charged to the desired level. As a result, a light transmittance can be performed at a correct gray level.

As described above, the source driver IC delays a source signal output, which maintains the source signal at a normal level while TFTs of the pixel are turned on. This effectively increases a gate turn-on pulse width by 7Tg/8 compared to the conventional art, which enhances a charging rate of the liquid crystal capacitor.

Figure 5:
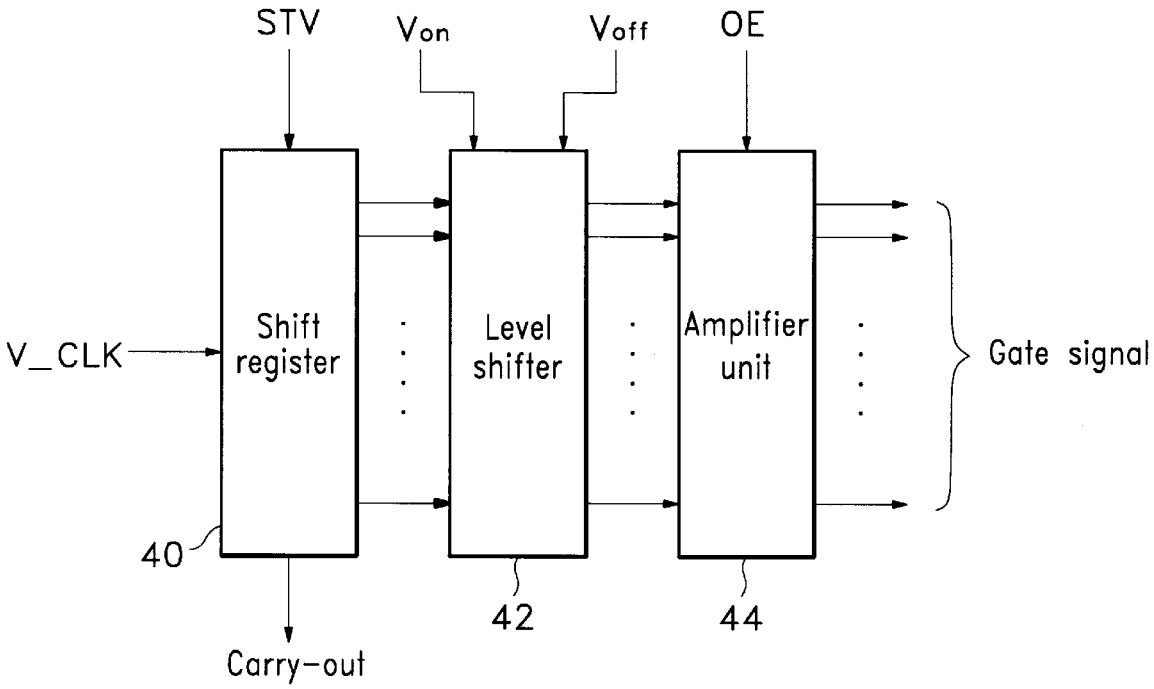
FIG. 5 is a detailed block diagram showing an individual gate driver IC of the gate drive unit shown in FIG. 3.
Figure 10:
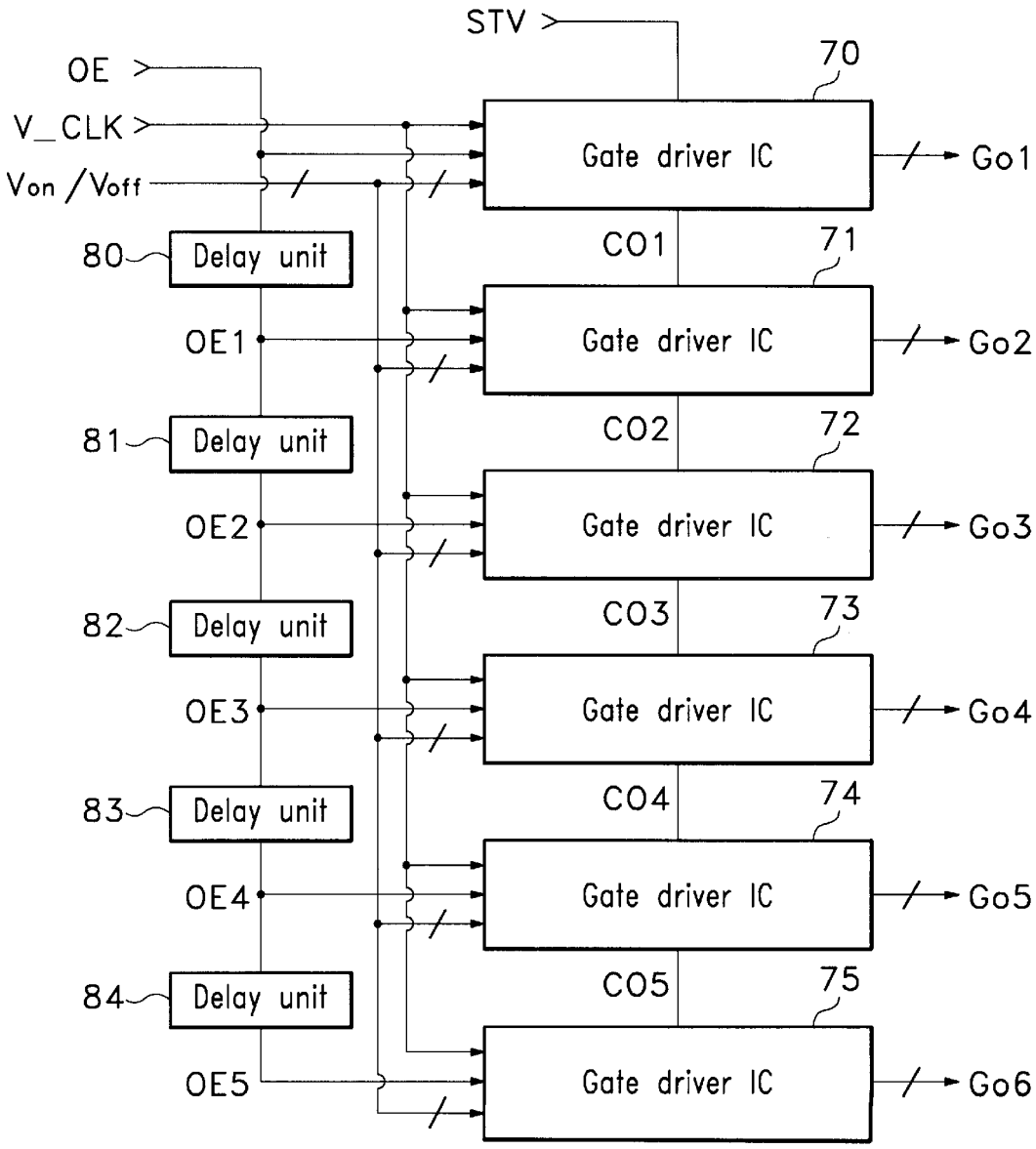
FIG. 10 is a block diagram showing a structure of the gate driver ICs constituting the gate drive unit shown in FIG. 3 according to a second embodiment of the present invention.

Gate drive unit 18 of the present invention consists of gate driver ICs shown in FIG. 5 has a structure as shown in FIG. 10.

The number of gate driver ICs of gate drive unit 18 can vary according to the manufacturer's specification and the display resolution. A second embodiment as shown in FIG. 10 consists of six gate driver ICs.

Gate drive unit 18 of FIG. 10 consists of gate driver ICs 70 through 75 that receive vertical clock signal V—CLK and turn-on voltage Von and turn-off voltage Voff.

Gate driver IC 70 also receives a shift signal STV and transmits the carry-out signal to the subsequent driver IC 71. The carry-out signal transmits to gate driver ICs 71 through 75.

Enable signal OE is input to a delay unit 80 and gate driver IC 70, and is delayed passing through delay units 80 through 84. Delay units 80 through 83 input enable signals OE1 through OE4 to gate driver IC 71 through 74 and delay units 81 through 84 respectively. Delay unit 85 inputs the final-delayed load signal TP7 to gate driver IC 75.

Provided that the total amount of delay time of the gate voltage is "A", the first enable signal OE is set to fall down by a time gap of A/6 after the source signal is applied. Delay units 80 through 84 delay the inputted enable signal by a period of A/6, respectively. As a result, enable signal OE5 applied to gate driver IC 75 falls down delayed by a period of A after the source signal. Gate driver ICs 70 through 75 output gate signals when enable signals OE through OE5 fall down. An output operation of the gate signal will be explained later.

Like the first embodiment, the delay unit is made up of an RC delay circuit having a resistance R and a capacitor C. The signal to an input terminal is delayed by a predetermined time period and output to an output terminal. Here, a parasitic capacitor formed by data lines and gate lines can be used.

In the second embodiment, the source signal is applied to the liquid crystal panel in a fashion that the source signal rises before the gate signal rises to a turn-on level and falls after the gate signal falls down to a turn-off level, for a selected pixel. The time gap between the respective risings of the source signal and the gate signal varies for each gate line.

Supposing that the time gap between the source signal and the most delayed gate signal is Ts, gate signals of gate driver ICs 70 through 75 are delayed by a period of Ts/number of gate driver ICs. Thus, gate signals Go1 through Go6 coming from gate driver ICs 70 through 75 are accumulatively delayed by a period of Ts/number of gate driver ICs. As a result, gate signal Go6 from the last gate driver IC rises delayed by a time gap Ts than the source signal.

Figure 11:
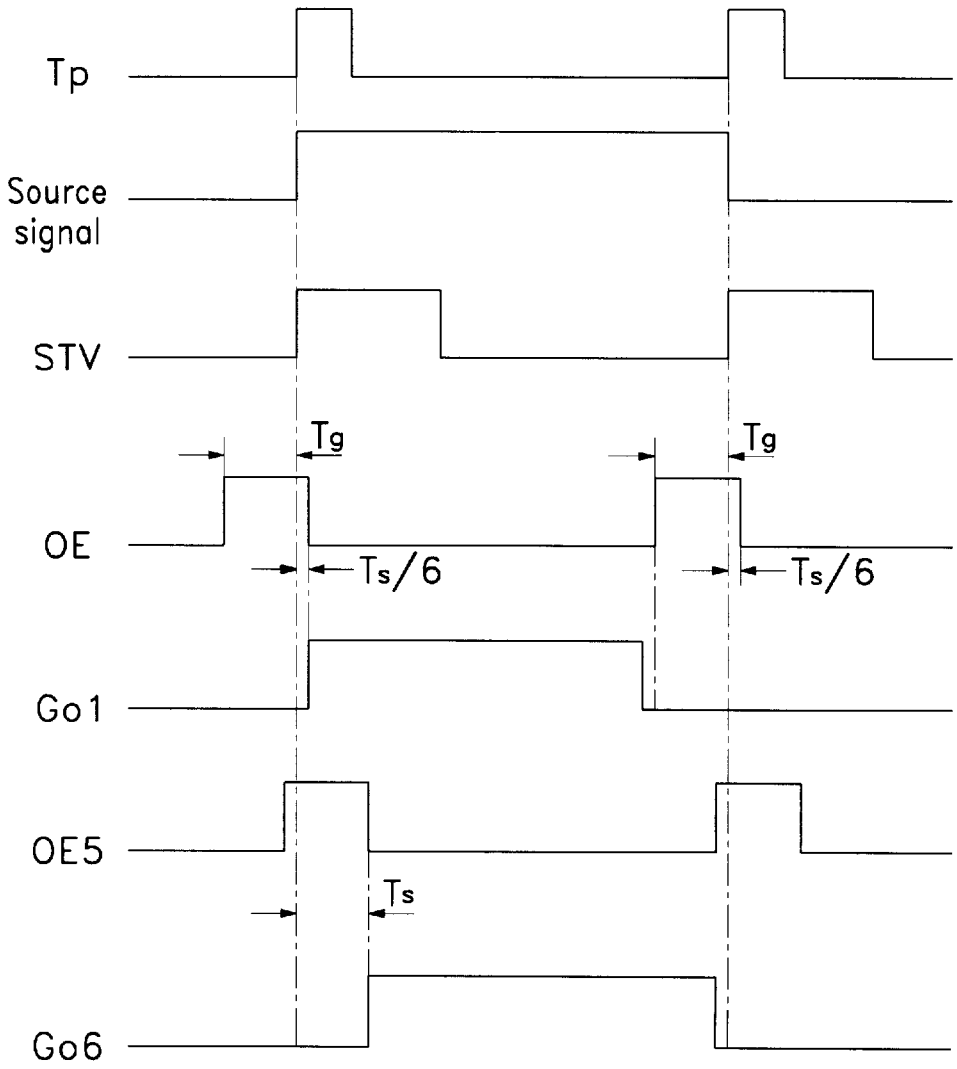
FIG. 11 illustrates a waveform of the delayed gate signal according to a second embodiment of the present invention.

Delay operation of the gate signal can be explained in more detail with reference to FIGS. 10 and 11. Data drive unit 20 outputs a source signal corresponding to the rising edge of the driving signal Tp, which comes from controller 10. Gate drive unit 18 receives shift signal STV and enable signal OE, and outputs gate signals Go1 through Go6 through gate driver ICs 70 through 75.

When gate driver IC 70 receives shift signal STV of which rising edge is the same as that of the source signal it generates a carry-out signal CO1 through the internal operation of the shift register and inputs the same to the subsequent gate driver IC 71 as a carry-in signal. Gate driver IC 71 in turn generates carry-out signal C02 through the internal operation of the shift register and inputs the same to the subsequent gate driver IC 72 as a carry-in signal. In such a manner, carry-out signals C01 through C05 are input to the subsequent gate driver IC. Shift signal STV or carry-out signals C01 through C05 respectively generates turn-on voltages at each gate driver ICs 70 through 75. When the enable signal is input, the gate driver ICs 70 through 75 receive the enable signal, turn-on voltages are output to the liquid crystal panel.

Pixels connected to gate driver IC 70 are the nearest to source drive unit 20. Therefore, the charging time for the source signal is short. On the contrary, pixels connected to gate driver IC 75 are the farthest from source drive unit 20. Therefore, the charging time for the source signal is longer.

Accordingly, gate driver ICs 70 through 75 output to a plurality of gate lines gate signals delayed by Ts/6, 2Ts/6, 3Ts/6, 4Ts/6, 5Ts/6, 6Ts/6(equals to Ts) compared to the source signal.

In detail, enable signal OE that falls down delayed by Ts/6 than the source signal is input to gate driver IC 70. Delay unit 80 delays enable signal OE by Ts/6 to generate OE1 and input to gate driver IC 71. Delay units 81 through 84 delay enable signals OE1 through OE5 by Ts/6 respectively and input the delayed signals to the corresponding gate driver ICs 72 through 75.

Accordingly, gate driver IC 71 outputs gate signal Go2 delayed by Ts/6 than gate driver IC 70, and gate driver IC 72 outputs gate signal Go3 delayed by Ts/6 than gate driver IC 71. As described above, the gate signal output is accumulatively delayed, and gate signal Go6 of gate driver IC 75 is output delayed by 5Ts/6 than those of the gate driver IC 70.

Figure 12:
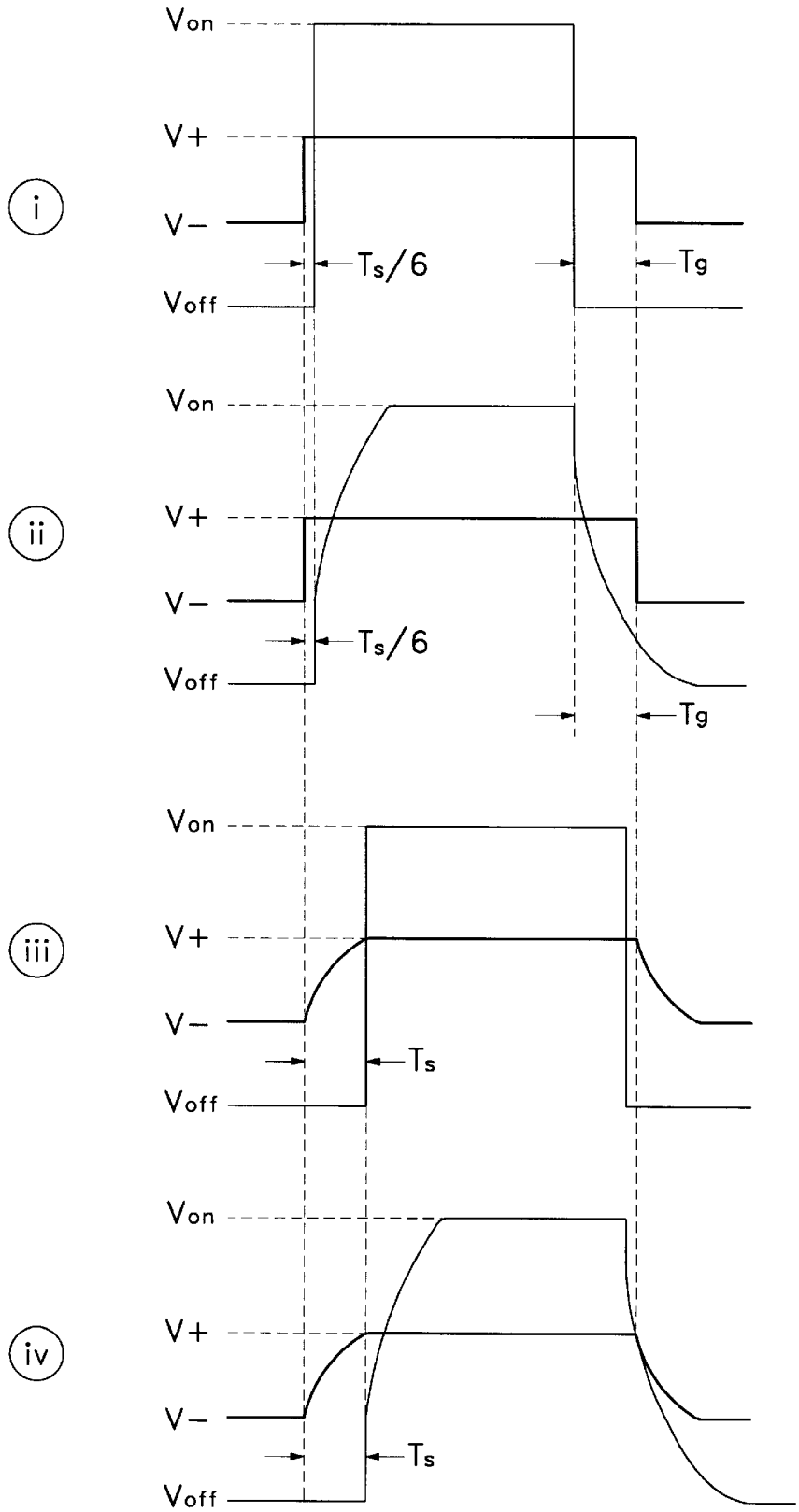
FIG. 12 illustrates waveforms of gate and source signals for each pixel according to a second embodiment of the present invention.

FIG. 12 shows source signals and gate signals applied to each pixel according to the second embodiment. Here, i) through iv) are source and gate signals applied to positions i) through iv) of liquid crystal panel 22 of FIG. 3. Positions i) and ii) are for the pixels that receive a source signal at first, and positions i) and iii) are for the pixels that receive a gate signal at first.

At positions i) and ii), the gate signal is applied being delayed by Ts/6 than the source signal. Gate signal Go1 output from source driver IC 70 is applied to pixels at positions i) and ii) at the same time. In addition, the gate signal is turned on while the source signal maintains a normal level. Thus, pixels at positions i) and ii) can be charged to the desired level. As a result, pixels at those positions can be projected at a correct gray level.

At positions iii) and iv) of liquid crystal panel 22, the gate signal is applied delayed by Ts than the source signal. Pixels at positions iii) and iv) receive at the same time gate signal Go6 coming from gate driver IC 75. Positions iii) and iv) are the farthest from the source drive unit and the source signal is extremely delayed due to the resistance and capacitance. The gate signal is turned on while the source signal maintains a normal level. Thus, pixels at positions iii) and iv) can be charged to the desired level. As a result, pixels at those positions can be projected at a correct gray level.

As described above, the gate driver IC outputs delayed gate signal, which turns on TFTs of the pixel while the source signal maintains a normal level. A gate turn-on time is 5Ts/6 longer than the conventional art, enhancing the charging rate of the liquid crystal capacitor.

The present invention adjusts the turn-on period of the gate signal to be included within the period while the level of the source signal is normal. Since the turn-on period of the gate signal has to be reduced to 15 $\mu$s or shorter to achieve a large screen and a high resolution display, the turn-on period of the gate signal has to be adjusted to be included within the period while the level of the source signal is normal, in order to enhance the charging rate of the liquid crystal capacitor.

The charging period for the source signal may vary due to the characteristics of TFTs. However, manufacturers may overcome this problem by adjusting the degree of the gate signal delay.

Although the embodiment of the present invention employs a method of delaying for each source driver IC, the delay time can be adjusted by the unit of two or three source driver ICs. In such a case, the delay unit may consists of two or three units of source driver ICs.

Delay units are one less than source or gate driver ICs, because the first load signal and the enable signal are delayed by the period corresponding to total delay time/number of source or driver ICs.

Figure 13:
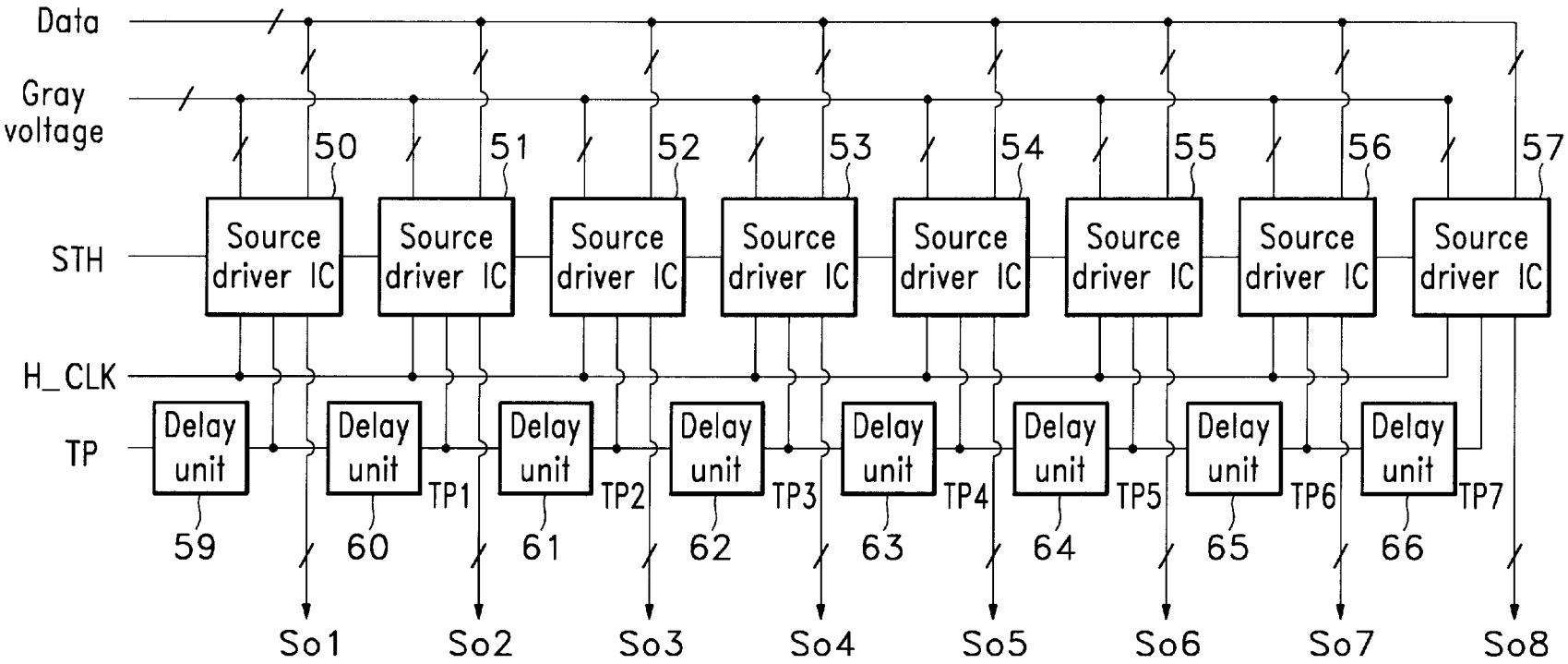
FIG. 13 is a block diagram showing a variation of the first embodiment of the present invention.
Figure 14:
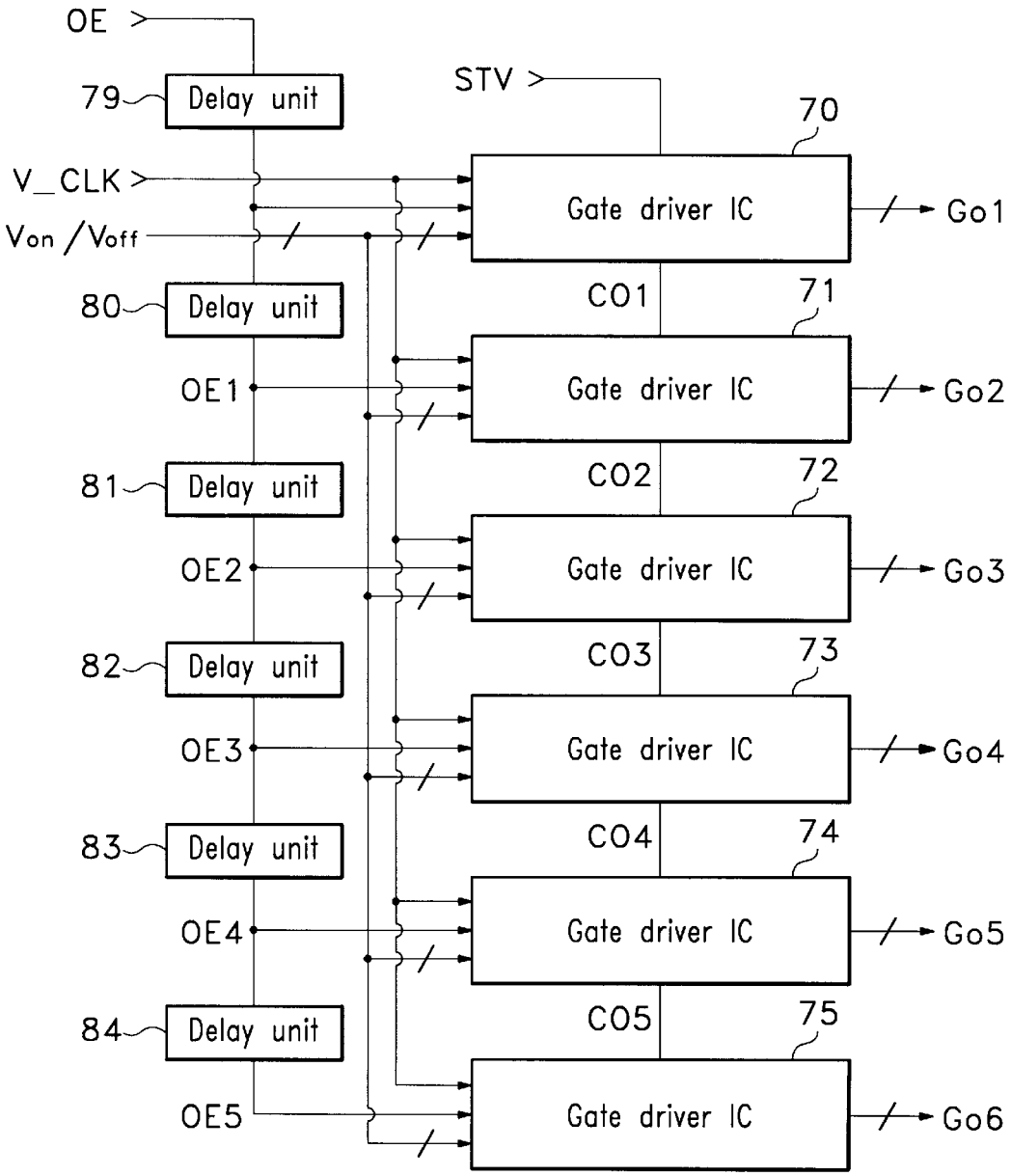
FIG. 14 is a block diagram showing a variation of the second embodiment of the present invention.

Unlike the above-described embodiments, delay units may one-to-one correspond to source driver ICs, as shown in FIGS. 13 and 14. In such a case, the first load signal and the enable signal are not delayed.

Referring to FIGS. 13 and 14, a load signal and an enable signal are input respectively to delay units 59 and 79 without a delay. The delay starts from the output signal of delay units 59 and 79. Thereafter, the load signal and the enable signal are delayed sequentially and the source and gate driver ICs operate in a manner similar to those as described on the first embodiment and the second embodiment of the present invention.

The present invention has benefits of enhanced screen uniformity by improving the rate of charging the source voltage to a liquid crystal capacitor for each pixel. Specifically, the present invention is applied to a large screen and a high resolution display, ensuring the sufficient charging rate even during a short period of gate signal turn-on. As a result, the picture quality is enhanced.

This invention has been described above with reference to the aforementioned embodiments. It is evident, however, that many alternative modifications and variations will be apparent to those having skills in the art in light of the foregoing description. Accordingly, the present invention embraces all such alternative modifications and variations as fall within the spirit and scope of the appended claims.

What is claimed is:

1. A driving system of an LCD device comprising:

a power supply unit for supplying a direct current voltage;

a controller for outputting data signals and control signals for forming a selected image;

a gray voltage generating unit for generating a plurality of gray voltages using a voltage supplied from said power supply unit;

a gate voltage generating unit for outputting a gate turn-on voltage or turn-off voltage using said voltage supplied from said power supply unit;

a data drive unit for outputting source signals, after receiving said data signals, and said gray voltages;

a gate drive unit for outputting gate signals, after receiving said control signals and said gate turn-off voltage or said turn-on voltage; and a liquid crystal panel for displaying said image by said gate signals and said source signals, wherein said data drive unit further comprises, a delay part that receives a load signal and outputs delayed load signals through a first, a second, a third, . . . , and an mth delay units, and n number of source driver ICs for outputting a selected number of source signals driven by said control signals wherein n is greater than or equal to m, and wherein said load signals coming from said delay units are applied to at least one source driver IC, and said source driver IC outputs said source signal delayed corresponding to a delayed time of said load signal.

2. The driving system of an LCD device according to claim 1, wherein said delay part is made up of serially arranged delay units with a resistance and a capacitor arranged in parallel, and wherein a first source drive IC and a first delay unit receives said delayed load signal and at least one source driver IC receives said load signals delayed by each delay unit.

3. The driving system of an LCD device according to claim 2, wherein said delay part has seven delay units that correspond one-to-one to source driver ICs, wherein a total delay time is included between a turn-off start time of a first gate signal and a falling start time of said source signal, and wherein each of said delay units applies a load signal being delayed respectively by 1/8 of said total delay time to said source driver ICs, whereby each corresponding source driver IC outputs a source signal being delayed respectively by 1/8 of said total delay time to said liquid crystal panel.

4. The driving system of an LCD device according to claim 2, wherein said delay devices correspond one-to-one to said source driver ICs.

5. The driving system of an LCD device according to claim 2, wherein said capacitor is a parasitic capacitor in said liquid crystal panel.

6. The driving system of an LCD device according to claim 2, wherein said delay unit corresponds one-to-plurality to said source driver ICs.

7. The driving system of an LCD device according to claim 1, wherein said delay part is made up of serially arranged delay units with a resistance and a capacitor arranged in parallel, and wherein a first delay unit receives said load signal and at least one source driver IC receives said load signals delayed by each delay unit.

8. The driving system of an LCD device according to claim 7, wherein said delay devices correspond one-to-one to said source driver ICs.

9. The driving system of an LCD device according to claim 7, wherein said capacitor is a parasitic capacitor in said liquid crystal panel.

10. The driving system of an LCD device according to claim 7, wherein said delay unit corresponds one-to-plurality to said source driver ICs.

11. A liquid crystal panel driving method, comprising steps of:

generating a control signal, including a data signal;

a data signal;

generating gray voltages;

raising a source signal according to said control signal, said data signal and said gray voltages;

raising a gate signal to a gate turn-on voltage;

restoring said gate signal to a gate turn-off voltage; and lowering said source signal, wherein said source signals are divided into a selected number of data line units and are applied to a liquid crystal panel accumulatively delayed after said gate signals start to fall down to a gate turn-off voltage.

12. The liquid crystal panel driving method according to claim 11, wherein said source signal is accumulatively delayed for each source driver IC and is applied to said liquid crystal panel.

13. The liquid crystal panel driving method according to claim 12, wherein the total delay time is included between the point when said gate signal starts to fall down to a gate turn-off voltage and a point when said finally delayed source signal starts to fall down, and wherein a source signal of a source driver IC nearest to an output terminal of said gate signal from said liquid crystal panel falls delayed by total delay time divided by total number of source driver ICs, and other source driver ICs output source signals are delayed accumulatively in sequence.

14. A driving system of an LCD device comprising:

a power supply unit for supplying a direct current voltage;

a controller for outputting data signals and control signals for forming a selected image;

a gray voltage generating unit for generating a plurality of gray voltages using a voltage supplied from said power supply unit;

a gate voltage generating unit for outputting a gate turn-on voltage or turn-off voltage using said voltage supplied from said power supply unit;

a data drive unit for outputting source signals, after receiving said data signals and said gray voltages;

a gate drive unit for outputting gate signals after receiving said control signals, and said gate turn-off voltage or said gate turn-on voltage; and a liquid crystal panel for displaying said image by said gate signals and said source signals, wherein said gate drive unit comprises, a delay part that receives an enable signal and outputs delayed enable signals through a first, a second, a third, . . . , and an xth delay units, and y number of gate driver ICs for outputting a selected number of gate signals driven by said control signals wherein, y is greater than or equal to x, and wherein said enable signals coming from said delay units are input to at least one gate driver IC, and said gate driver IC outputs said gate signal delayed corresponding to a delayed time of said enable signal.

15. The driving system of an LCD device according to claim 14, wherein said delay part is made up of serially arranged delay units with a resistance and a capacitor arranged in parallel and at least one gate driver IC receives said enable signal and enable signals delayed by each delay unit.

16. The driving system of an LCD device according to claim 15, wherein said delay part has five delay units that correspond one-to-one to gate driver ICs, wherein said first delay unit receives said enable signal and a first gate driver IC is delayed by 1/6 of a total delay time after a source signal is applied, and wherein each of said five delay units provides an enable signal delayed by 1/6 of said total delay time to corresponding gate driver ICs in order to provide a gate signal delayed by 1/6 of said total delay time to said liquid crystal panel.

17. The driving system of an LCD device according to claim 15, wherein said delay part has six delay units that correspond one-to-one to gate driver ICs, a first delay unit inputs an enable signal delayed by 1/6 of a total delay time to a first gate driver IC and a second delay unit after a source signal is applied, and wherein said second through a sixth delay units input enable signals being delayed by 1/6 of said total delay time, respectively, to corresponding gate driver ICs to delay each output of a gate signal to said liquid crystal panel by 1/6 of said total delay time.

18. The driving system of an LCD device according to claim 15, wherein said delay units correspond one-to-one to said gate drive lCs.

19. The driving system of an LCD device according to claim 15, wherein said capacitor is a parasitic capacitor in said liquid crystal panel.

20. A liquid crystal panel driving method, comprising steps of:

generating a control signal, including a data signal;

generating gray voltages;

raising a source signal according to said control signal, said data signal and said gray voltages;

raising a gate signal to a gate turn-on-voltage; restoring said gate signal to a gate turn-off voltage; and lowering said source signal, wherein said gate signals are divided into a selected number of gate line units and are applied to a liquid crystal panel accumulatively delayed after said source signal is applied.

21. The liquid crystal panel driving method according to claim 20, wherein said gate signal is delayed by each gate driver IC and is applied to said liquid crystal panel.

22. The liquid crystal panel driving method according to claim 21, wherein a gate driver IC nearest to an output terminal of said source signal outputs a gate signal delayed by a period of total delay time divided by the total number of gate driver ICs, and other said gate driver ICs output gate signals in sequence accumulatively delayed by said period of total delay time divided by the total number of gate driver ICs.

* * * * *